US005316280A

United States Patent [19]

Watkiss

[11] Patent Number: 5,316,280

[45] Date of Patent: May 31, 1994

[54] STITCHING AND FOLDING APPARATUS WITH PIVOTABLE BODY

[75] Inventor: Christopher R. Watkiss, Biggleswade, England

[73] Assignee: Watkiss Automation Limited, Bedfordshire, England

[21] Appl. No.: 934,750

[22] PCT Filed: Jan. 22, 1992

[86] PCT No.: PCT/GB92/00125

§ 371 Date: Oct. 6, 1992

§ 102(e) Date: Oct. 6, 1992

[87] PCT Pub. No.: WO92/12860

PCT Pub. Date: Aug. 6, 1992

[30] Foreign Application Priority Data

Jan. 22, 1991 [GB] United Kingdom ..... 9101377

[51] Int. Cl.[5] ..... B41L 43/00; B42C 1/00

[52] U.S. Cl. ..... 270/37; 270/45

[58] Field of Search ..... 270/32, 37, 45, 20.1, 270/49, 50; 493/405, 416, 417, 455, 457, 384, 385, 437

[56] References Cited

U.S. PATENT DOCUMENTS 3,117,777 1/1964 Funk ..... 493/457 X 4,270,742 6/1981 Kobayashi ..... 270/37

4,410,170 10/1983 Wertheimer et al. ..... 270/37

4,957,284 9/1990 Brabant ..... 270/37

5,000,432 3/1991 Krasuski et al. ..... 270/45

FOREIGN PATENT DOCUMENTS 0038942 11/1981 European Pat. Off. .

0352694 1/1990 European Pat. Off. .

*Primary Examiner*—Edward K. Look

*Assistant Examiner*—John Ryznic

*Attorney, Agent, or Firm*—Seidel, Gonda, Lavorgna & Monaco

[57] ABSTRACT

Apparatus for stitching and folding sheets of material, especially paper, comprising an in-feed unit, a wire-stitching unit, a sheet-folding unit and an out-feed conveyor. The sheets are maintained in a downward linear path from entry into the in-feed unit until initiation of the folding by a folding blade. Removal of the folded sheets is substantially perpendicular to the previous downward linear path. The sheets abut a first stop for the stitching, and abut a second stop for the folding. The in-feed unit and the wire-stitching unit are pivotable relative to the rest of the machine in the manner of a clam-shell. All units remain engaged with a main drive in both the closed and opened positions.

18 Claims, 3 Drawing Sheets

STITCHING AND FOLDING APPARATUS WITH PIVOTABLE BODY

This invention relates to methods of and apparatus for fastening together sheets of material, in particular apparatus that stitches and folds sheets of paper into book form.

By the folding of sheets of paper into book form is meant the doubling over of a plurality of overlaid sheets of paper, usually a maximum of about twenty sheets, to form a pamphlet, brochure, magazine or the like. By the reference to stitching is primarily meant the use of metal wire to fasten the sheets together, in the manner of staples.

Known machines which stitch and fold sheets of paper are arranged with a stitching assembly and a folding assembly positioned about a conveyor along which the sheets of material travel in a generally linear horizontal path. To permit access to the moving parts the stitching and folding assemblies must be separate, resulting in a lengthy, bulky device which takes up a lot of floor space. Such machines are also difficult to set up and require continuous minding by a skilled operator.

It is an object of the present invention to rearrange the geometry of the important elements of such a machine, so that the stitching and folding assemblies are substantially one above the other and thus the path that the sheets of material travel through the machine is short. This results in a more compact apparatus that occupies a smaller floor space.

It is another object of the invention to provide a machine in which one can gain easy access to all the working parts. Access to the functional parts is possible with all drives still engaged as at least some of the sub-assemblies pivot in a fan-like movement about the drive shaft. The machine can be opened and closed in the manner of a clam-shell, for inspection, for maintenance or to remove paper jams. The apparatus is easy to set up and can be operated by unskilled personnel.

In accordance with one aspect of the invention there is provided apparatus for stitching and folding sheets of material, comprising in-feed means arranged to receive a plurality of overlaid sheets, stitching means arranged to insert at least one fastening stitch through the sheets, folding means to fold the stitched sheets, and out-feed means for the folded sheets, wherein the sheet path is downwards through the in-feed means, and the stitching and the initiation of the folding is effected on the sheets without the sheets leaving a rectilinear path which is a straight line continuation of the path through the in-feed means.

In accordance with another aspect of the invention there is provided apparatus for stitching and folding sheets of material, comprising in-feed means for sheets of material, stitching means to stitch a plurality of said sheets together, folding means to fold the stitched sheets, and out-feed means, wherein the sheet path is downwards through the in-feed means and generally horizontally at about 90° to the in-feed direction through the out-feed means.

Also in accordance with the invention there is provided apparatus for stitching and folding sheets of material, comprising in-feed means for sheets of material, stitching means to stitch a plurality of said sheets together, folding means to fold the stitched sheets, and out-feed means, wherein the in-feed means the stitching means are pivotable relative to fixed-position folding means and fixed-position out-feed means.

The invention also includes a method of stitching and folding sheets of material comprising the steps of feeding sheets of material downwards into in-feed means, holding the sheets at a first position and effecting stitching of the sheets together, moving the stitched sheets to a second position and effecting a folding of the sheets, and removing the folded sheets from the folding station, wherein the sheets follow a linear path from entry into the in-feed means until initiation of the folding.

The downward motion of the sheets in the apparatus is as near to vertical as is practicable consistent with maintaining stability of the sheets, in practice of the order of 20° from the true vertical.

In order that the invention may be more fully understood, one presently preferred embodiment of apparatus in accordance with the invention will now be described by way of example and with reference to the accompanying drawings, in which.

Figure 1:
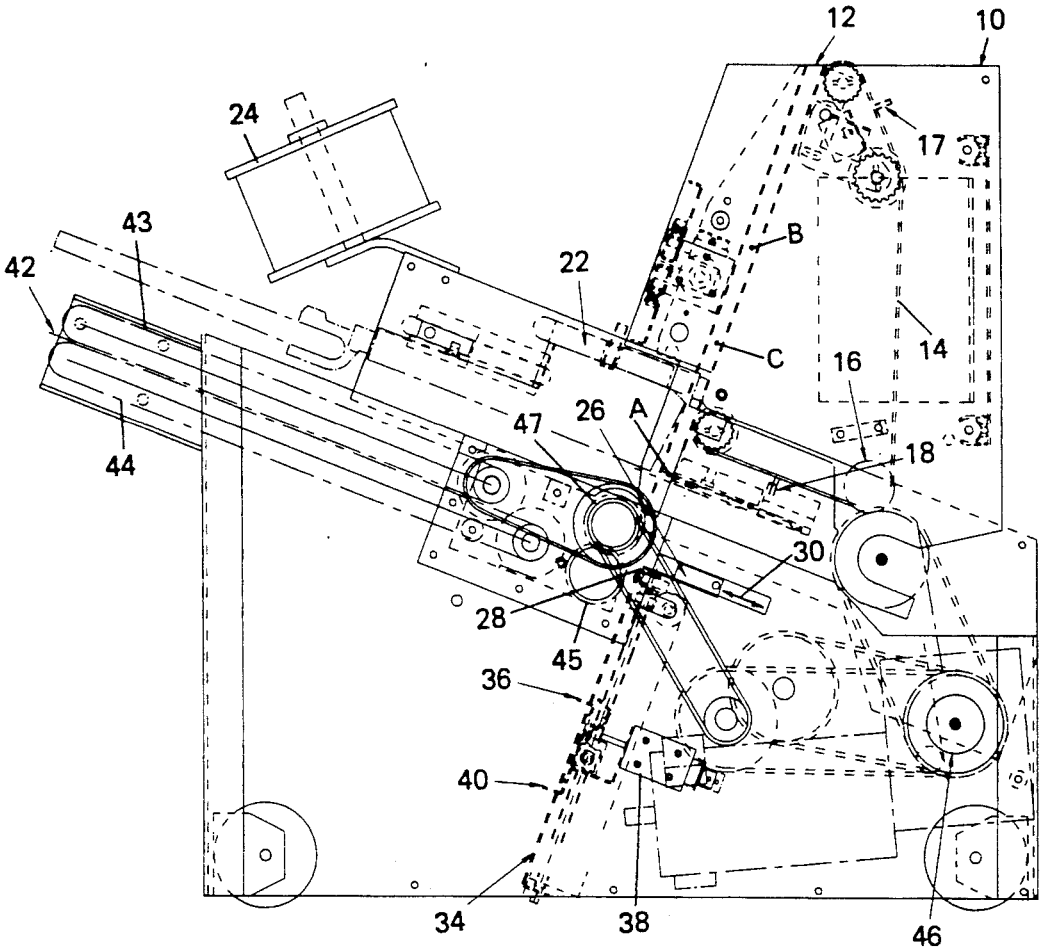
FIG. 1 shows the stitcher/folder machine in its closed, operative state.
Figure 2:
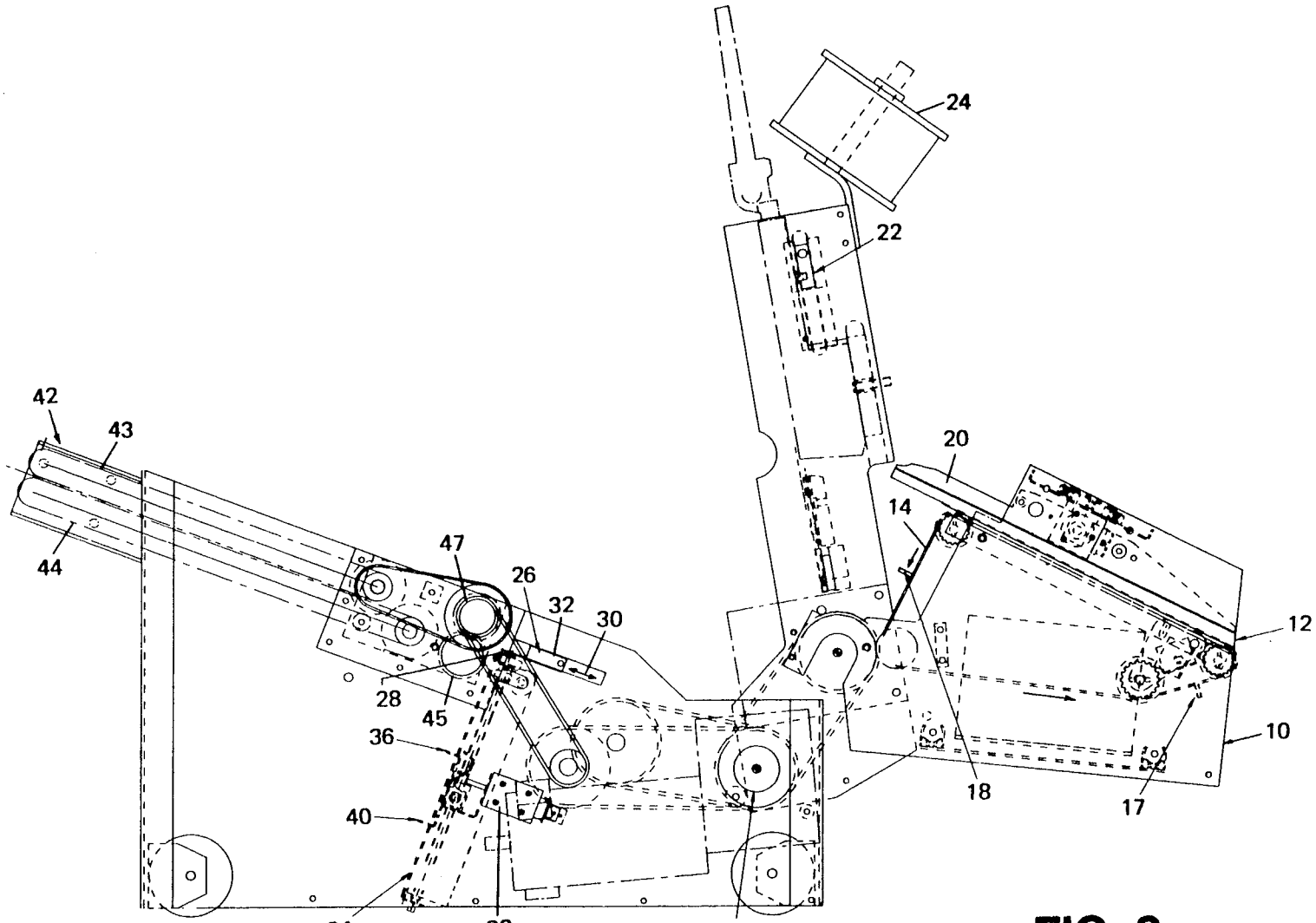
FIG. 2 shows the machine in an opened state.

The stitcher/folder machine shown in the drawings comprises an in-feed assembly, indicated generally at 10, which defines a downwardly directed receiving channel 12 (FIG. 1) for receiving a plurality of overlaid sheets of material, for example sheets of paper. The apparatus will be described hereinafter with reference to sheets of paper. The receiving channel 12 is essentially vertical in its attitude when the machine is closed up for operation. By "essentially vertical" is meant that the receiving channel is inclined at a relatively small angle off the true vertical. The channel must be set off vertical in order to prevent the sheets of paper from falling forwards, but it should be kept as vertical as possible consistent with maintaining stability of the stack of sheets in the channel. As shown in FIG. 1, the angle of inclination from the vertical of the receiving channel 12 is about 20°. Centrally within the receiving channel and at the underside of the sheets of paper is an endless belt 14 which is guided around gearwheels and pulleys within the in-feed assembly and which is rotationally driven from the main drive of the machine by way of an in-feed driver 16. The endless belt 14 is provided with two projecting dogs 17, 18 which extend outwardly and which thus form abutments within the path of the sheets in the receiving channel. At each side of the receiving channel 12 there is provided a joggle plate 20 (FIG. 2). The joggle plates 20 can be moved back and forth perpendicular to the direction of movement of the sheets of paper in order to knock them from the sides into accurate overlaid registration. The dogs 17, 18 on the belt 14 are used to effect a top knocking of the sheets in an analogous manner to ensure accurate registration in the longitudinal direction.

The stitch assembly is indicated generally at 22. It includes two reels 24 of stitching wire (only one of which is shown in the drawings) and is adapted in use to insert a pair of staples through the overlaid sheets of paper at the position indicated at A in FIG. 1. The stitch assembly 22 is conventional in structure and mode of operation and will therefore not be described in more detail.

A knife-fold assembly is indicated generally at 26 and comprises a blade 28 which is reciprocally movable into and out of the linear path of the stack of sheets, as indicated by the double-headed arrow 30, under the control of a solenoid 32. The blade 28 extends the full width of the sheets of paper and preferably has an undulating leading edge, for example of generally sinusoidal shape, in order to provide better contact with the sheets of paper. In a preferred embodiment the leading edge of the blade 28 is recessed slightly in the zones where the blade would otherwise strike the staples, in order to avoid any possible misalignment arising from the blade striking the staples.

Below the knife-fold assembly 26 is a fold plate assembly, indicated generally at 34 which constitutes a carriage for a pair of stops. These are stops which define the position of the sheets for the stitching and folding operations respectively. The first stop is a stitch stop 36 which, as shown in the drawings, is pivotable into and out of the linear path of the sheets of paper under the control of a solenoid 38. For the stitching operation, the stitch stop 36 is pivoted into the path of the sheets of paper and the lower edge of the stack of sheets rests against the stop. With the lower edge of the stack of sheets resting against the stitch stop, the upper edge of the stack of sheets is positioned at the point indicated at B in FIG. 1.

The second stop is a fold stop 40, which is a fixed position stop against which the lower edge of the stack of sheets is arranged to rest when the stack is in the position ready to be folded. With the stack of sheets in this position the upper edge of the stack is positioned at the point indicated at C in FIG. 1.

It will be appreciated from the general geometry of the arrangement that the distance between the stitch stop 36 and the fold stop 40 is equal to the distance between the stitching point A and the folding point at the blade 28.

An out-feed conveyor is indicated generally at 42 and is powered to take the stitched and folded sheets from the folding assembly 26 out in a generally horizontal direction and at right angles to the path of the stack of sheets within the machine during the stitching and folding process. The out-feed conveyor 42 comprises upper and lower belts 43, 44 between which the folded sheets pass. When initially contacted by the blade 28 the sheets are guided and engaged by rollers 45, 47 before passing between the belts 43, 44.

The main drive for the machine is indicated at 46. Control of the movement of the various sub-assemblies within the machine is effected from the main drive 46 by way of appropriate transmission means such as belts and gears, as indicated schematically in the drawings.

As will be seen from the drawings, the folding assembly 26 and the out-feed conveyor 42 are fixed in their relative positions. However, both the in-feed assembly 10 and the stitch assembly 22 are pivotable relative to the rest of the machine. As shown in FIG. 2, the in-feed assembly 10 is pivotable through an angle of about 90° and the stitch assembly is shown as pivotable through an angle of approximately 70° between their "closed" positions and their "open" positions. In an alternative embodiment, the in-feed assembly 10 and the stitch assembly 22 are pivoted jointly through a common angle, instead of one being pivotable further than the other.

By virtue of the fact that the in-feed assembly 10 and the stitch assembly 22 can be pivoted relative to the rest of the apparatus in a fan-like movement around the drive shafts, in a clam-shell motion, all the functional parts of the machine are made readily accessible for adjustment, maintenance, repair or the removal of paper jams. It is to be noted that the various drives will remain engaged when the in-feed assembly and stitch assembly are pivoted into their opened position, thereby ensuring that the apparatus does not need to be readjusted or reset when the apparatus is closed up again for subsequent operation. The previously set positions will remain accurately set.

Although not shown in the drawings, adjustment means are provided to set the mechanisms and to permit the positions of for example the stops 36 and 40 to be set for different sizes of paper sheets.

Figure 3:
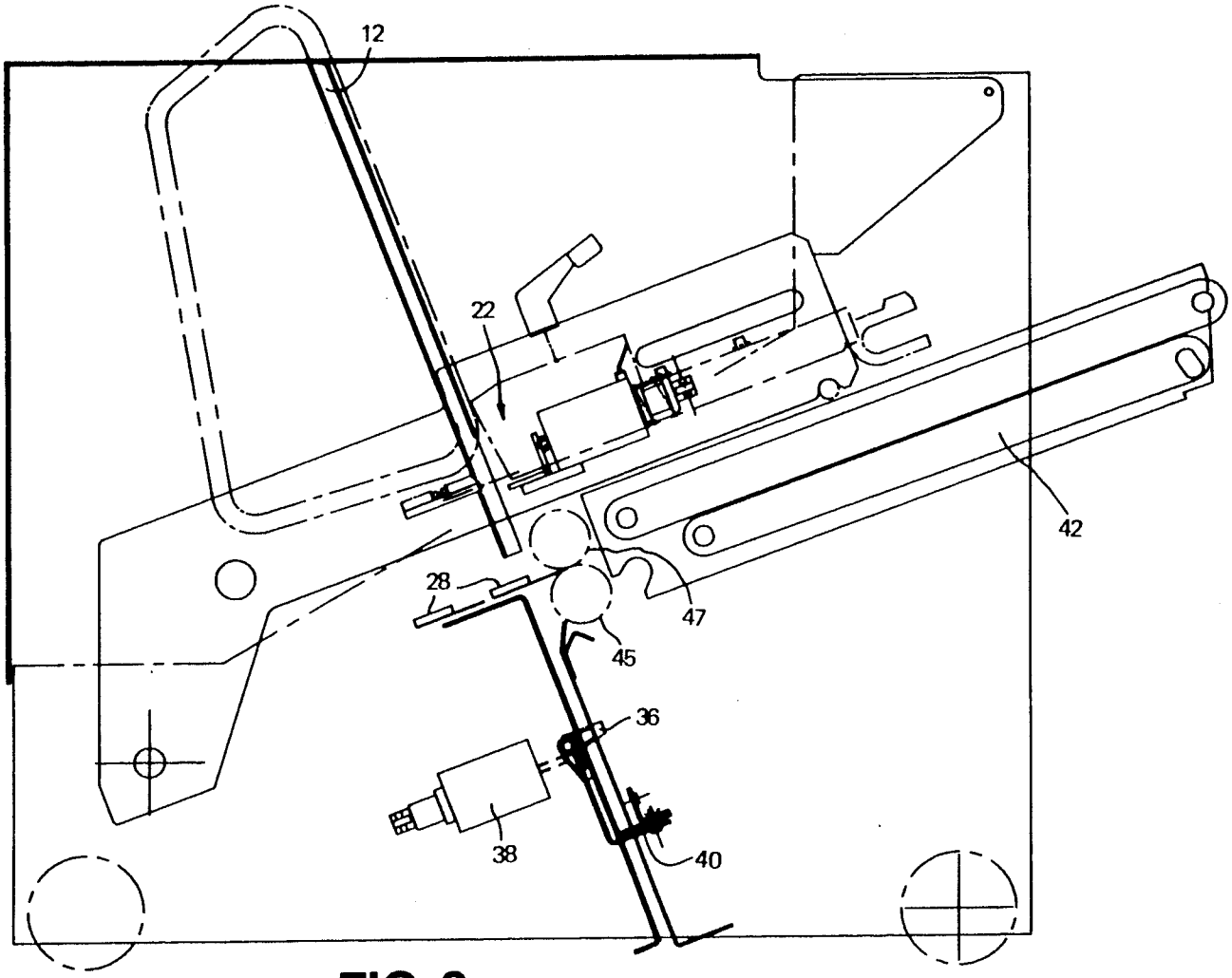
FIG. 3 shows a simplified illustration of the interior features of the machine.

In operation, with the machine closed up as shown in FIG. 1, a stack of sheets of paper, up to about 20 in number, is fed into the receiving channel 12. The stack of sheets may be the output of a collating machine, such as the collating machine described in our International patent application WO 91/04215. The stack of sheets which drops into the receiving channel is given a top knock by the dogs 17, 18 on the belt 14, which can move relative to the stack of sheets and thus bring the dogs into striking engagement with the upper and lower edges of the sheets, and then is given a side knock by the joggle plates 20. Referring to FIG. 3, with the sheets thus accurately in register they pass downwards in a rectilinear path until they strike the stitch stop 36. At this stage the folding blade 28 is retracted. The stitch assembly 22 is then actuated to insert the wire stitches or staples through the sheets at A. The stitch stop 36 is then retracted by energization of the solenoid 38 and the stitched sheets move downwards into contact with the fold stop 40. The folding blade 28 is then energized to move outwards towards the sheets, to strike them at the level of the wire stitches and cause them to be folded about the stitches and to be passed generally horizontally outwards through the out-feed conveyor 42. On the out-feed conveyor side of the blade 28 guide means are provided to assist in the folding of the sheets about their centre as the blade performs its folding function. The rollers 45 and 47 are provided to entrain the folded sheets at this position.

It will clearly be appreciated from FIG. 3 that the path followed by the sheets through the machine is extremely short and that the machine itself is extremely compact. The sheets move in a rectilinear path from their initial receipt into the machine until the initiation of the folding movement, whereafter they are moved substantially at right-angles to their previous path. In particular, the stitching operation and the initiation of the folding operation are both carried out on the stack of sheets of paper without the stack having departed from its initial path upon entry into the machine. This minimises problems of maintaining accurate registration of the sheets and minimises the problems which arise from extended paths of movement of sheets of paper. Also, the downward linear path of movement of the sheets means that one is using the weight of the sheets to assist in the process, in contrast to known machines where the sheets are moved generally horizontally and where one is working against the weight of the sheets.

I claim:

1. Apparatus for stitching and folding sheets of material, comprising in-feed means arranged to receive a plurality of overlaid sheets on a downward path, stitching means arranged to insert at least one fastening stitch through the sheets, folding means to fold the stitched sheets, said stitching means and folding means further arranged such that the stitching means are encountered by the sheets before the folding means on a continuous rectilinear path of travel, said rectilinear path defining a downward straight line continuation of the path through the in-feed means, and out-feed means for the stitched and folded sheets, wherein the stitching and initiation of folding is effected on the sheets without the sheets leaving the rectilinear path downward from the in-feed means.

2. Apparatus for stitching and folding sheets of material, comprising in-feed means for sheets of material, said in-feed means comprising means to knock the sheets to bring them into registration, said knocking means comprising an endless driven belt against which the sheets are placed upon entry into the in-feed means, said belt having projections which guide the sheets and effect knocking of the sheets in their direction of travel;

stitching means to stitch a plurality of said sheets together;

folding means to fold the stitched sheets;

and out-feed means;

wherein the in-feed means and the stitching means are pivotable relative to fixed-position folding means and fixed position out-feed means.

3. Apparatus according to claim 2, in which the sheet path is downwards through the in-feed means.

4. Apparatus according to claim 3, in which the sheets pass down through the in-feed means at an angle of the order of 20° to the vertical.

5. Apparatus according to claim 2, in which the folding means comprises a blade movable towards and away from the stitched sheets and having a non-linear contact surface for engagement with the sheets.

6. Apparatus according to claim 5, in which the contact surface of the folding blade is undulating.

7. Apparatus for stitching and folding sheets of material, comprising in-feed means for sheets of material;

stitching means to stitch a plurality of said sheets together;

folding means to fold the stitched sheets;

first and second spaced stops against which the leading edges of the sheets abut, the first stop receiving the leading edges for the stitching of the sheets and the second stop receiving the leading edges for the folding of the sheets, the distance between said first and second stops being substantially equal to the distance between the position at which the stitching means contacts the sheets and the position at which the folding means contacts the sheets;

and out-feed means, wherein the in-feed means and the stitching means are pivotable relative to fixed-position folding means and fixed-position out-feed means.

8. Apparatus according to claim 7, in which the sheet path is downwards through the in-feed means.

9. Apparatus according to claim 8, in which the sheets pass down through the in-feed means at an angle of the order of 20° to the vertical.

10. Apparatus according to claim 7, in which the folding means comprises a blade movable towards and away from the stitched sheets and having a non-linear contact surface for engagement with the sheets.

11. Apparatus according to claim 10, in which the contact surface of the folding blade is undulating.

12. Apparatus according to claim 7, in which the stitching position is above the folding position in the path of travel of the sheets through the apparatus.

13. Apparatus for stitching and folding sheets of material, comprising in-feed means for sheets of material;

stitching means to stitch a plurality of said sheets together;

folding means to fold the stitched sheets;

and out-feed means, wherein the in-feed means and the stitching means are pivotable relative to fixed-position folding means and fixed-position out-feed means;

the in-feed means, the stitching means, the folding means and the out-feed means all being connected to a main drive means in such a manner that at least some of these means can be moved to permit access thereto whilst remaining engaged with the main drive means.

14. Apparatus for stitching and folding sheets of material, comprising in-feed means for sheets of material, said in-feed means comprising means to knock the sheets to bring them into registration, wherein said knocking means knocks the sheets both at their ends and at their sides, said knocking means comprising an endless driven belt against which the sheets are placed upon entry into the in-feed means, said belt having projections which guide the sheets and effect knocking of the sheets in their direction of travel;

stitching means to stitch a plurality of said sheets together;

folding means to fold the stitched sheets;

and out-feed means;

wherein the in-feed means and the stitching means are pivotable relative to fixed-position folding means and fixed position out-feed means.

15. Apparatus according to claim 14, in which the sheet path is downwards through the in-feed means.

16. Apparatus according to claim 15, in which the sheets pass down through the in-feed means at an angle of the order of 20° to the vertical.

17. Apparatus according to claim 14, in which the folding means comprises a blade movable towards and away from the stitched sheets and having a non-linear contact surface for engagement with the sheets.

18. Apparatus according to claim 17, in which the contact surface of the folding blade is undulating.

* * * * *